US010457362B2

(12) United States Patent
Arias

(10) Patent No.: US 10,457,362 B2
(45) Date of Patent: Oct. 29, 2019

(54) COLLAPSIBLE FLOTATION DEVICE

(71) Applicant: Kelsyus, LLC, Virginia Beach, VA (US)

(72) Inventor: David A. Arias, Virginia Beach, VA (US)

(73) Assignee: Kelsyus, LLC, Virginia Beach, VA (US)

( * ) Notice: Subject to any disclaimer, the term of this patent is extended or adjusted under 35 U.S.C. 154(b) by 0 days.

(21) Appl. No.: 15/849,183

(22) Filed: Dec. 20, 2017

(65) Prior Publication Data

US 2018/0265175 A1 Sep. 20, 2018

Related U.S. Application Data

(63) Continuation of application No. 14/980,596, filed on Dec. 28, 2015, now Pat. No. 9,849,949, which is a continuation of application No. 14/016,876, filed on Sep. 3, 2013, now Pat. No. 9,221,526, which is a continuation of application No. 13/328,779, filed on Dec. 16, 2011, now Pat. No. 8,523,623, which is a (Continued)

(51) Int. Cl.

| | |
|---|---|
| ***B63C 9/08*** | (2006.01) |
| ***B63B 7/08*** | (2006.01) |
| ***B63B 35/607*** | (2006.01) |
| ***B63B 35/76*** | (2006.01) |
| ***B63C 9/04*** | (2006.01) |
| ***B63C 9/105*** | (2006.01) |
| ***B63B 35/73*** | (2006.01) |

(52) U.S. Cl.

CPC ..... *B63C 9/081* (2013.01); *B63B 7/08* (2013.01); *B63B 35/607* (2013.01); *B63B 35/73* (2013.01); *B63B 35/76* (2013.01); *B63C 9/04* (2013.01); *B63C 9/08* (2013.01); *B63C 9/082* (2013.01); *B63C 9/1055* (2013.01); *B63C 2009/042* (2013.01)

(58) Field of Classification Search

CPC ..... B63C 9/081; B63C 9/1055; B63C 9/082; B63C 9/08; B63C 9/04

See application file for complete search history.

(56) References Cited

U.S. PATENT DOCUMENTS

| | | | |
|---|---|---|---|
| 722,801 | A | 3/1903 | Bourne, Jr. |
| 772,690 | A | 10/1904 | Baswitz |

(Continued)

FOREIGN PATENT DOCUMENTS

| | | |
|---|---|---|
| CN | 2274170 | 2/1998 |
| EP | 0974293 | 1/2000 |

(Continued)

OTHER PUBLICATIONS

Office Action in Australian Patent Application No. 2002213464, dated May 26, 2005; 2 pages.

(Continued)

*Primary Examiner* — Stephen P Avila

(57) ABSTRACT

A device comprises a spring and a sleeve. The spring is configured to form a closed loop. The spring is moveable between a coiled configuration when the spring is collapsed and an uncoiled configuration when the spring is expanded. The spring defines a circumference while in the uncoiled configuration. The spring is disposed within the sleeve.

17 Claims, 5 Drawing Sheets

Related U.S. Application Data continuation of application No. 12/890,240, filed on Sep. 24, 2010, now Pat. No. 8,079,888, which is a continuation of application No. 12/400,214, filed on Mar. 9, 2009, now Pat. No. 7,811,145, which is a continuation of application No. 12/028,227, filed on Feb. 8, 2008, now Pat. No. 7,500,893, which is a continuation of application No. 11/554,197, filed on Oct. 30, 2006, now Pat. No. 7,335,080, which is a continuation of application No. 11/143,703, filed on Jun. 3, 2005, now Pat. No. 7,134,930, which is a continuation of application No. 10/847,339, filed on May 18, 2004, now Pat. No. 7,147,528, which is a continuation of application No. 10/295,906, filed on Nov. 18, 2002, now Pat. No. 7,097,524, which is a continuation of application No. 09/772,739, filed on Jan. 30, 2001, now Pat. No. 6,485,344.

(60) Provisional application No. 60/238,988, filed on Oct. 10, 2000.

(56) References Cited

U.S. PATENT DOCUMENTS 856,279 A 6/1907 Moore
1,190,743 A 7/1916 Fageol
1,479,903 A 1/1924 Erland
1,960,474 A * 5/1934 Browne ..... B63C 9/08 441/129
2,119,023 A 5/1938 Pickard
2,173,963 A 9/1939 Eubank
2,190,566 A 2/1940 Julian
2,207,025 A 7/1940 Rison
2,334,924 A 11/1943 Hansen
2,344,010 A 3/1944 Walsh
2,357,789 A 9/1944 Levy
2,360,715 A 10/1944 Perry
2,420,344 A 5/1947 Alexander
2,442,105 A 5/1948 Vacheron
2,637,861 A 5/1953 Kethledge
2,731,997 A 1/1956 Muth et al.
2,803,291 A 8/1957 Meyer
2,803,839 A 8/1957 Mosley
2,870,464 A 1/1959 Lalick
D187,313 S 2/1960 Denyer
2,953,184 A 9/1960 Erstad
3,052,895 A 9/1962 Lo Vico
3,336,610 A 8/1967 Geddings
3,339,218 A 9/1967 Stamberger
3,602,930 A 9/1971 Channon
3,653,084 A 4/1972 Hartman
D225,183 S 11/1972 Waters
3,740,095 A 6/1973 Nail
3,775,782 A 12/1973 Rice et al.
3,842,454 A 10/1974 Young
3,860,976 A 1/1975 Suyama
3,862,876 A 1/1975 Graves
3,871,042 A 3/1975 Farmer
D236,287 S 8/1975 McNair
3,960,161 A 6/1976 Norman
3,990,463 A 11/1976 Norman
4,097,944 A 7/1978 Yulish
4,200,942 A 5/1980 Case
4,231,125 A 11/1980 Tittl
D261,464 S 10/1981 Smith
4,296,788 A 10/1981 Slater
4,435,236 A 3/1984 Inae et al.
4,478,587 A 10/1984 Mackal
4,512,049 A 4/1985 Henry
4,561,480 A 12/1985 Underwood et al.
4,576,375 A 3/1986 Roberts
4,693,691 A 9/1987 DeYoe
D293,012 S 12/1987 Storey et al.
4,709,430 A 12/1987 Nicoll
4,766,918 A 8/1988 Oderkirk
4,815,784 A 3/1989 Zheng
4,825,892 A 5/1989 Norman
4,858,634 A 8/1989 McLeese
4,861,300 A 8/1989 Casagrande et al.
4,942,838 A 7/1990 Boyer et al.
4,944,707 A 7/1990 Silverglate
4,946,067 A 8/1990 Kelsall
4,951,333 A 8/1990 Kaiser et al.
4,973,278 A 11/1990 Williams
4,976,642 A 12/1990 Wilkie
4,986,781 A 1/1991 Smith
5,006,087 A 4/1991 Peterson
5,024,262 A 6/1991 Huang
5,038,812 A 8/1991 Norman
5,045,011 A 9/1991 Lovik
5,046,978 A 9/1991 Howerton
5,056,172 A 10/1991 Kaiser et al.
5,059,463 A 10/1991 Peters
5,070,807 A 12/1991 Lewis
5,088,723 A 2/1992 Simmons
D325,489 S 4/1992 Pratt
5,116,273 A * 5/1992 Chan ..... A45B 23/00 160/370.21
5,123,869 A 6/1992 Schipmann
D328,324 S 7/1992 Wang
5,163,192 A 11/1992 Watson
5,163,461 A 11/1992 Ivanovich et al.
5,167,554 A 12/1992 Tager
5,186,667 A 2/1993 Wang
5,206,964 A 5/1993 Wilson, Sr.
5,213,147 A 5/1993 Zheng
5,261,131 A 11/1993 Kilby
5,299,331 A 4/1994 Badillo
D349,593 S 8/1994 Hensley
D349,625 S 8/1994 da Palma
5,334,067 A 8/1994 Henry et al.
D350,586 S 9/1994 Francis
5,345,627 A 9/1994 Cammarata
5,358,440 A 10/1994 Zheng
5,385,518 A 1/1995 Turner
5,396,917 A 3/1995 Hazinski et al.
5,409,411 A 4/1995 Schrieber
5,430,980 A 7/1995 Ferrier
5,433,433 A 7/1995 Armell
5,435,025 A 7/1995 Gerard et al.
5,454,643 A 10/1995 Sullivan
5,467,794 A 11/1995 Zheng
5,476,404 A 12/1995 Price
D366,177 S 1/1996 Dean
5,520,561 A * 5/1996 Langenohl ..... B63B 35/78 441/129
D371,252 S 7/1996 Chaput
5,533,653 A 7/1996 Kaufman
D373,483 S 9/1996 Peterson
5,560,385 A 10/1996 Zheng
5,571,036 A 11/1996 Hannigan
5,579,799 A 12/1996 Zheng
5,592,961 A 1/1997 Chin
D378,772 S 4/1997 Hall
5,618,110 A 4/1997 Sullivan
5,618,246 A 4/1997 Zheng
5,619,759 A 4/1997 Hansen et al.
RE35,571 E 7/1997 McLeese
5,644,807 A 7/1997 Battistella
5,688,052 A 11/1997 Compton
5,693,398 A 12/1997 Granger
D389,362 S 1/1998 Boulatian
5,718,612 A 2/1998 Elsholz
5,729,846 A 3/1998 Sullivan
5,730,529 A 3/1998 Fritz et al.
D398,694 S 9/1998 Boddy
5,810,695 A 9/1998 Sass
5,816,954 A 10/1998 Zheng
D400,749 S 11/1998 Bechtold, Jr.
D404,104 S 1/1999 Scheurer et al.
D406,870 S 3/1999 Bauman
5,885,123 A 3/1999 Clifford

(56) References Cited

U.S. PATENT DOCUMENTS

| | | | | |
|---|---|---|---|---|
| D409,971 | S | 5/1999 | Elsholz | |
| 5,976,023 | A | 11/1999 | Cho | |
| 6,012,778 | A | 1/2000 | Peterson | |
| 6,030,300 | A | 2/2000 | Zheng | |
| D424,313 | S | 5/2000 | Linder | |
| D425,357 | S | 5/2000 | Waring | |
| D426,415 | S | 6/2000 | Le Gette et al. | |
| D426,714 | S | 6/2000 | Linder | |
| 6,073,283 | A | 6/2000 | Zheng | |
| D428,090 | S | 7/2000 | Peterson | |
| D428,099 | S | 7/2000 | Peterson | |
| 6,086,150 | A | 7/2000 | Scheurer et al. | |
| 6,113,453 | A | 9/2000 | Stuffelbeam | |
| D435,240 | S | 12/2000 | Peterson | |
| 6,161,902 | A | 12/2000 | Lieberman | |
| 6,168,489 | B1 | 1/2001 | Huston | |
| 6,170,100 | B1 | 1/2001 | Le Gette et al. | |
| 6,192,635 | B1 | 2/2001 | Zheng | |
| 6,223,673 | B1 | 5/2001 | Mears et al. | |
| 6,224,444 | B1 | 5/2001 | Klimenko | |
| 6,225,940 | B1 | 5/2001 | Ohlsen | |
| 6,257,943 | B1 | 7/2001 | Peterson | |
| 6,276,979 | B1 | 8/2001 | Saltel et al. | |
| D447,661 | S | 9/2001 | Le Gette et al. | |
| D449,193 | S | 10/2001 | Le Gette et al. | |
| 6,312,054 | B1 | 11/2001 | Scheurer et al. | |
| 6,343,391 | B1 * | 2/2002 | Le Gette ..... | A47G 9/062 5/417 |
| D459,934 | S | 7/2002 | Le Gette et al. | |
| D463,700 | S | 10/2002 | Le Gette et al. | |
| D466,176 | S | 11/2002 | Peterson | |
| 6,478,038 | B1 | 11/2002 | Le Gette et al. | |
| 6,485,344 | B2 | 11/2002 | Arias | |
| 6,491,558 | B1 | 12/2002 | Myers | |
| D469,494 | S | 1/2003 | Arias | |
| 6,527,343 | B2 | 3/2003 | Scheurer et al. | |
| 6,589,089 | B1 | 7/2003 | Glass et al. | |
| D480,777 | S | 10/2003 | Peterson | |
| D481,435 | S | 10/2003 | Zheng | |
| 6,634,040 | B2 | 10/2003 | Le Gette et al. | |
| 6,645,026 | B2 | 11/2003 | Kuan | |
| D483,088 | S | 12/2003 | Zheng | |
| D492,380 | S | 6/2004 | Zheng | |
| 6,908,353 | B2 | 6/2005 | Zheng | |
| 6,915,537 | B2 | 7/2005 | Le Gette et al. | |
| 6,971,936 | B2 | 12/2005 | Le Gette et al. | |
| 7,008,281 | B2 | 3/2006 | Ketko | |
| 7,097,524 | B2 | 8/2006 | Arias | |
| 7,127,754 | B2 | 10/2006 | Le Gette et al. | |
| 7,134,930 | B2 | 11/2006 | Arias | |
| 7,137,856 | B2 | 11/2006 | Zheng | |
| 7,147,528 | B2 | 12/2006 | Arias | |
| 7,207,857 | B2 | 4/2007 | Zheng | |
| 7,210,976 | B2 | 5/2007 | Gordon | |
| D556,284 | S | 11/2007 | Peterson | |
| 7,335,080 | B2 | 2/2008 | Arias | |
| 7,370,379 | B2 | 5/2008 | Zheng | |
| 7,490,378 | B2 | 2/2009 | Le Gette et al. | |
| D596,438 | S | 7/2009 | Le Gette et al. | |
| D610,216 | S | 2/2010 | Le Gette et al. | |
| 7,665,164 | B2 | 2/2010 | Le Gette et al. | |
| 7,727,038 | B2 | 6/2010 | Le Gette et al. | |
| D632,914 | S | 2/2011 | Le Gette et al. | |
| D640,492 | S | 6/2011 | Le Gette et al. | |
| D642,232 | S | 7/2011 | Le Gette et al. | |
| 8,057,272 | B1 | 11/2011 | Wray et al. | |
| 8,066,540 | B2 | 11/2011 | Le Gette et al. | |
| 8,079,888 | B2 * | 12/2011 | Arias ..... | B63B 7/08 441/129 |
| D654,749 | S | 2/2012 | Le Gette et al. | |
| D679,770 | S | 4/2013 | Berenson | |
| 8,657,640 | B2 | 2/2014 | Le Gette et al. | |
| D702,058 | S | 4/2014 | Le Gette et al. | |
| D719,233 | S | 12/2014 | Maria | |
| 8,959,679 | B1 | 2/2015 | Everds et al. | |
| D725,209 | S | 3/2015 | Wampold | |
| D742,139 | S | 11/2015 | Le Gette | |
| D744,052 | S | 11/2015 | Rubey | |
| 9,221,526 | B2 | 12/2015 | Arias | |
| 9,630,687 | B2 | 4/2017 | Le Gette et al. | |
| 9,849,949 | B2 * | 12/2017 | Arias ..... | B63B 7/08 |
| 2002/0049017 | A1 | 4/2002 | Ross | |
| 2003/0068940 | A1 | 4/2003 | Arias | |
| 2003/0134549 | A1 | 7/2003 | Lekhtman | |

FOREIGN PATENT DOCUMENTS

| | | | |
|---|---|---|---|
| EP | 1 008 706 | A2 | 6/2000 |
| FR | 2697421 | | 11/1992 |
| FR | 2697421 | | 4/1996 |
| GB | 258077 | | 9/1926 |
| GB | 2108435 | B | 4/1985 |
| JP | 48024199 | U | 7/1971 |
| JP | 48-024199 | U | 3/1973 |
| JP | 52-002895 | U | 1/1977 |
| JP | 1-133961 | U | 9/1989 |
| JP | 4-065567 | U | 6/1992 |
| WO | WO 1999/059452 | A1 | 11/1999 |

OTHER PUBLICATIONS

Office Action in Canadian Patent Application No. 2,425,348, dated Aug. 7, 2006; 2 pages.
Office Action in Chinese Patent Application No. 01819143.6, dated Feb. 17, 2006; 9 pages.
Office Action in Chinese Patent Application No. 01819143.6, dated Aug. 18, 2006; 5 pages.
Office Action in Chinese Patent Application No. 01819143.6, dated Feb. 27, 2009; 5 pages.
Office Action in Chinese Patent Application No. 01819143.6, dated Jul. 3, 2009; 6 pages.
Office Action in European Patent Application No. 01 981 847.5, dated May 17, 2006; 3 pages.
Office Action in Japanese Patent Application No. 2002-534140, dated Jan. 15, 2007; 2 pages.
Office Action in Japanese Patent Application No. 2002-534140, dated Jan. 15, 2008; 2 pages.
Office Action in Mexican Patent Application No. PA/a/2003/002949 PCT, dated Mar. 7, 2006; 3 pages.
Office Action in Australian Patent Application No. 2006202846, dated Apr. 7, 2009; 2 pages.
Office Action in Japanese Patent Application No. 2008-127246, dated Jan. 17, 2011, 2 pages.
Office Action for Chinese Patent Application No. 201010003813.8; dated Aug. 29, 2011; 13 pages.
Office Action for Chinese Patent Application No. 201010003813.8; dated Feb. 29, 2012; 8 pages.
Office Action for Australian Patent Application No. 2011202582; dated Jul. 29, 2011; 3 pages.
Office Action for Chinese Patent Application No. 201010003813.8, dated Sep. 5, 2012, 9 pages.
Defendant's Prior Art Statement, filed on Sep. 30, 2013 in *Swimways Corporation* v. *Aqua-Leisure Industries, Inc.* 3:12-cv-00205, 66 pages.
Markman Order, issued on Oct. 22, 2013, in *Swimways Corporation* v. *Aqua-Leisure Industries, Inc.* 3:12-cv-00205, 5 pages.
Aqua-Leisure 1993 Catalog, pp. 7, 12-13.
Bestway 2000 Catalog, pp. 8, 15, 28, and 73-74.
Bestway 2002 Catalog, 2 pages.
Bestway 2003 Catalog, pp. 36, 51-52, 54.
Intex 1994 Catalog, pp. 17, 30.
Intex 1999 Catalog, p. 41.
Intex 2001 Catalog, p. 34.
Swimline 1999 Catalog, pp. A1, 19.
Swimline 2002 Catalog, p. 31.
"How to Fold a Bicycle Tire," http://www.rideyourbike.com/tirefold.html, pp. 1-2, Mar. 9, 2001.
Swimclass Baby Boat packaging 2003.
Aqua-Leisure Adjustable Sunshade Wave Rider packaging 2001.

(56) References Cited

OTHER PUBLICATIONS

Aqua-Leisure Baby Boat packaging 1992.
Aqua-Leisure Squirtin' Tootin' Tugboat packaging 2001.
Don Hubbard, The Complete Book of Inflatable Boats (1980).
Hawley's Condensed Chemical Dictionary, Definition of "Resin, Synthetic" p. 1004 (1987).
Life Buoy as a Water Hammock, 16 Popular Mechanics, No. 3, 309, 313 (1911).
Swimways 1995 Catalog, Swimways Corp., 1995, pp. 5 and 18-19.
Swimways 1996 Catalog, Swimways Corp., 1996, pp. 4 and 20-23.
Swimways 1997 Catalog, Swimways Corp., 1997, pp. 6 and 18-20.
Swimways 1998 Catalog, Swimways Corp., 1998, pp. 13 and 15-17.
Swimways 1999 Catalog, Swimways Corp., 1999, pp. 10 and 21-22.
Swimways 2000 Catalog, Swimways Corp., 2000, pp. 2-5 and 17.
Swimways Lounges Summer 2001 Catalog, Swimways Corp., 2001, pp. 2-8.
Defendant Aqua-Leisure Industries, Inc.'s Amended Counterclaims, filed on Sep. 20, 2016 in *Swimways Corporation et al.* v. *Aqua-Leisure Industries, Inc.* 2:16-cv-00260, 19 pages.
Defendant Bestway (USA) Inc.'s Opening Expert Report of Samir Nayfeh, Ph.D. Relating to the Validity of U.S. Pat. No. 7,811,145; U.S. Pat. No. 8,079,888; and U.S. Pat. No. 8,066,540, filed on Nov. 3, 2016 in *Swimways Corporation et al.* v. *Bestway* (*USA*) *Inc.* 1:16-cv-608, 120 pages.
Schedule C-1 of Defendant Bestway (USA) Inc.'s Opening Expert Report of Samir Nayfeh, Ph.D. Relating to the Validity of U.S. Pat. No. 7,811,145; U.S. Pat. No. 8,079,888; and U.S. Pat. No. 8,066,540, filed on Nov. 3, 2016 in *Swimways Corporation et al.* v. *Bestway* (*USA*) *Inc.* 1:16-cv-608, 13 pages.
Schedule C-2 of Defendant Bestway (USA) Inc.'s Opening Expert Report of Samir Nayfeh, Ph.D. Relating to the Validity of U.S. Pat. No. 7,811,145; U.S. Pat. No. 8,079,888; and U.S. Pat. No. 8,066,540, filed on Nov. 3, 2016 in *Swimways Corporation et al.* v. *Bestway* (*USA*) *Inc.* 1:16-cv-608, 7 pages.
Schedule C-3 of Defendant Bestway (USA) Inc.'s Opening Expert Report of Samir Nayfeh, Ph.D. Relating to the Validity of U.S. Pat. No. 7,811,145; U.S. Pat. No. 8,079,888; and U.S. Pat. No. 8,066,540, filed on Nov. 3, 2016 in *Swimways Corporation et al.* v. *Bestway* (*USA*) *Inc.* 1:16-cv-608, 15 pages.
Schedule C-4 of Defendant Bestway (USA) Inc.'s Opening Expert Report of Samir Nayfeh, Ph.D. Relating to the Validity of U.S. Pat. No. 7,811,145; U.S. Pat. No. 8,079,888; and U.S. Pat. No. 8,066,540, filed on Nov. 3, 2016 in *Swimways Corporation et al.* v. *Bestway* (*USA*) *Inc.* 1:16-cv-608, 24 pages.
Schedule C-5 of Defendant Bestway (USA) Inc.'s Opening Expert Report of Samir Nayfeh, Ph.D. Relating to the Validity of U.S. Pat. No. 7,811,145; U.S. Pat. No. 8,079,888; and U.S. Pat. No. 8,066,540, filed on Nov. 3, 2016 in *Swimways Corporation et al.* v. *Bestway* (*USA*) *Inc.* 1:16-cv-608, 26 pages.
Schedule C-6 of Defendant Bestway (USA) Inc.'s Opening Expert Report of Samir Nayfeh, Ph.D. Relating to the Validity of U.S. Pat. No. 7,811,145; U.S. Pat. No. 8,079,888; and U.S. Pat. No. 8,066,540, filed on Nov. 3, 2016 in *Swimways Corporation et al.* v. *Bestway* (*USA*) *Inc.* 1:16-cv-608, 8 pages.
Schedule C-7 of Defendant Bestway (USA) Inc.'s Opening Expert Report of Samir Nayfeh, Ph.D. Relating to the Validity of U.S. Pat. No. 7,811,145; U.S. Pat. No. 8,079,888; and U.S. Pat. No. 8,066,540, filed on Nov. 3, 2016 in *Swimways Corporation et al.* v. *Bestway* (*USA*) *Inc.* 1:16-cv-608, 13 pages.
Examination Report for Australian Patent Application No. 2015203143, dated Sep. 23, 2016.
Claim Construction Order, dated Apr. 24, 2017, in *Swimways Corporation et al.* v. *Aqua-Leisure Industries, Inc.* 2:16-cv-00260, 33 pages.
Plaintiffs' Opening Claim Construction Brief, filed Feb. 28, 2017 in *Swimways Corporation et al.* v. *Aqua-Leisure Industries, Inc.* 2:16-cv-00260, 32 pages.
Aqua-Leisure's Opening Claim Construction Brief, filed Feb. 28, 2017 in *Swimways Corporation et al.* v. *Aqua-Leisure Industries, Inc.* 2:16-cv-00260, 34 pages.
*Swimways Corp.,* v. *Overbreak, LLC*, Order, Case No. 1:04cv627, dated Jan. 18, 2005.
*Swimways Corp.,* v. *Overbreak, LLC*, Memorandum Opinion, Case No. 1:04cv627, dated Jan. 21, 2005.
Merriam-Websters Collegiate Dictionary ($10^{th}$ ed. 1998) pp. 190, 337, 598.
Examination Report for Australian Patent Application No. 2017203437, dated Feb. 27, 2018.

* cited by examiner

COLLAPSIBLE FLOTATION DEVICE

CROSS REFERENCE TO RELATED APPLICATION

This application is a continuation of U.S. application Ser. No. 14/980,596, filed Dec. 28, 2015 (now U.S. Pat. No. 9,849,949), which is a continuation of U.S. application Ser. No. 14/016,876, filed Sep. 3, 2013 (now U.S. Pat. No. 9,221,526), which is a continuation of U.S. application Ser. No. 13/328,779, filed Dec. 16, 2011 (now U.S. Pat. No. 8,523,623), which is a continuation of U.S. application Ser. No. 12/890,240, filed Sep. 24, 2010 (now U.S. Pat. No. 8,079,888), which is a continuation of U.S. application Ser. No. 12/400,214, filed Mar. 9, 2009 (now U.S. Pat. No. 7,811,145), which is a continuation of U.S. application Ser. No. 12/028,227, filed Feb. 8, 2008 (now U.S. Pat. No. 7,500,893), which is a continuation of U.S. application Ser. No. 11/554,197, filed Oct. 30, 2006 (now U.S. Pat. No. 7,335,080), which is a continuation of Ser. No. 11/143,703, filed Jun. 3, 2005 (now U.S. Pat. No. 7,134,930), which is a continuation of U.S. application Ser. No. 10/847,339, filed May 18, 2004 (now U.S. Pat. No. 7,147,528), which is a continuation of U.S. application Ser. No. 10/295,906, filed Nov. 18, 2002, (now U.S. Pat. No. 7,097,524), which is also a continuation of U.S. application Ser. No. 09/772,739, filed Jan. 30, 2001, (now U.S. Pat. No. 6,485,344), which claims priority from U.S. Provisional Application Ser. No. 60/238,988, filed Oct. 10, 2000; the entire disclosures of which are incorporated herein by reference.

BACKGROUND OF THE INVENTION

1. Field of the Invention

The present invention relates to inflatable flotation devices. In particular, the present invention relates to inflatable flotation devices which are collapsible through use of a spring mechanism.

2. Description of the Related Art

Inflatable flotation devices are well known in the form of floats, rafts, lifeboats, life preservers and other like devices. Previously known devices generally maintain their shape through air pressure alone and generally collapse when deflated.

In one of many examples, U.S. Pat. No. 3,775,782 issued to Rice et al. describes an inflatable rescue raft. When deflated, the raft can be rolled into a compact size.

Also well known in the art are collapsible items which are collapsible through the use of a collapsible metal or plastic spring. U.S. Pat. No. 4,815,784 shows an automobile sun shade which uses these collapsible springs. The springs are also used in children's play structures (U.S. Pat. Nos. 5,618,246 and 5,560,385) and tent-like shade structures (U.S. Pat. Nos. 5,579,799 and 5,467,794).

The collapsible springs are typically retained or held within fabric sleeves provided along the edges of a piece of fabric or other panel. The collapsible springs may be provided as one continuous loop, or may be a strip or strips of material connected at the ends to form a continuous loop. These collapsible springs are usually formed of flexible coilable steel, although other materials such as plastics are also used. The collapsible springs are usually made of a material which is relatively strong and yet is flexible to a sufficient degree to allow it to be coiled. Thus, each collapsible spring is capable of assuming two configurations, a normal uncoiled or expanded configuration, and a coiled or collapsed configuration in which the spring is collapsed into a size which is much smaller than its open configuration. The springs may be retained within the respective fabric sleeves without being connected thereto. Alternatively, the sleeves may be mechanically fastened, stitched, fused, or glued to the springs to retain them in position.

SUMMARY OF THE DISCLOSURE

A device comprises a spring and a sleeve. The spring is configured to form a closed loop. The spring is moveable between a coiled configuration when the spring is collapsed and an uncoiled configuration when the spring is expanded. The spring defines a circumference while in the uncoiled configuration. The spring is disposed within the sleeve. The sleeve includes an inflatable portion disposed about at least a portion of the circumference.

It is therefore an object of the present invention to provide a collapsible flotation device.

It is another object of the present invention to provide a collapsible flotation device which is easily collapsed and extended to full size through a mechanical means.

It is yet another object of the present invention to provide a collapsible flotation device which is easily collapsed and extended to full size through the use of a spring.

It is yet a further object of the present invention to provide a collapsible flotation device which requires minimal force to twist and fold into the collapsed configuration.

Finally, it is an object of the present invention to accomplish the foregoing objectives in a simple and cost effective manner.

DETAILED DESCRIPTION OF THE PREFERRED EMBODIMENTS

Figure 1:
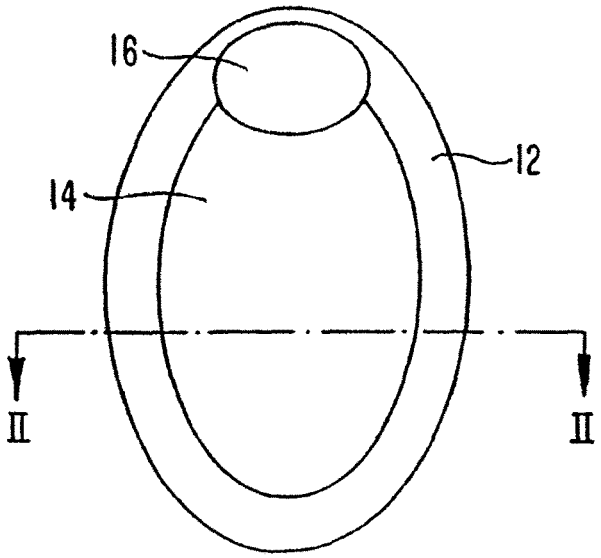
FIG. 1 is a top view of the preferred embodiment of the present invention.

The following detailed description is of the best presently contemplated modes of carrying out the invention. This description is not to be taken in a limiting sense, but is made merely for the purpose of illustrating general principles of embodiments of the invention.

The present invention provides a collapsible flotation device. The device includes a coilable metal or plastic spring. The coilable spring can be made from other materials, however, it is important that the coilable spring be made from a material that is strong and flexible. The spring must be coilable such that it folds on top of itself to become more compact. In its uncoiled state, the coilable spring can be round or oval or any shape satisfactory for use as a flotation device. Because it is to be used in water, the coilable spring is preferably either manufactured from a waterproof material or coated to protect any material which is not waterproof. The coilable spring can be a single continuous element or can include a joining means, such as a sleeve, for joining the ends of one or more spring elements together. The coilable spring can be of any appropriate shape and dimension. The coilable spring also has memory such that is biased to return to its uncoiled configuration when not held in the coiled configuration.

Stretched across the coilable spring is a flexible panel of material. The flexible panel can be one continuous piece or can be made up of several different types of material. In a preferred embodiment, the center portion of the flexible panel is mesh to allow water to flow through while the perimeter edges are nylon or polyester. At the edges of the flotation device, the material is a double thickness, forming a pocket around the perimeter of the flotation device. In this pocket are one or more inflatable chambers. One inflatable chamber may surround the entire perimeter of the flotation device or it may be divided into two or more inflatable chambers with each inflatable chamber having a means for inflating and deflating the inflatable chamber. In a preferred embodiment, one inflatable chamber is specifically designed to accommodate the user's head. In this embodiment, the pocket formed by the material is wider along a small portion of the perimeter of the flotation device to allow for a wider inflatable chamber. This will prevent the user's head from sinking below the rest of the user's body. The size of the inflatable chamber can vary significantly and need only be as wide as necessary to support the user's body weight. A preferred embodiment includes an inflatable chamber which is 3 inches in diameter when inflated. The inflatable chamber can be made from any appropriate float material but is preferably resistant to punctures. The coilable spring may also be located within the perimeter pocket. If one inflatable chamber is selected, the coilable spring can be placed inside or outside the inflatable chamber. If multiple inflatable chambers are used, the coilable spring will be outside the inflatable chambers. Alternatively, the coilable spring may be located outside the perimeter pocket along the outer edge of the flotation device. The coilable spring may be attached to the flexible panel through mechanical means such as fastening, stitching, fusing, or gluing.

Figure 2:
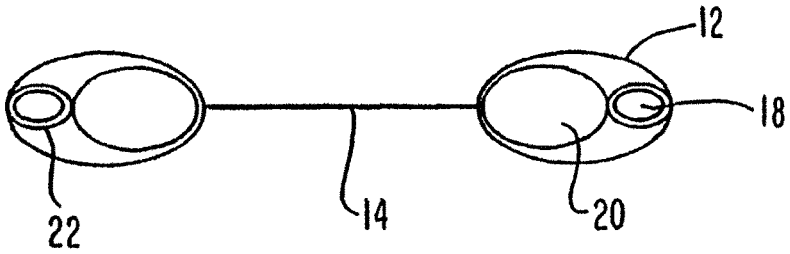
FIG. 2 is a cross sectional view of the preferred embodiment of the present invention taken along line II-II of FIG. 1.
Figure 3:
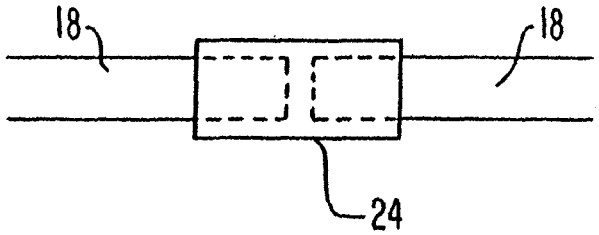
FIG. 3 is a view of a joining method as used in one embodiment of the present invention.

A preferred embodiment of the flotation device is shown in FIGS. 1 and 2 in its expanded configuration. The perimeter pocket 12 portion of the flexible panel is nylon while the central portion 14 of the flexible panel is made from a mesh material. The pillow 16 is part of the perimeter pocket 12 as it includes a double layer of fabric to accept an inflatable chamber 20 between the layers of fabric. In this particular embodiment, there are two inflatable chambers 20 in the perimeter pocket of the flotation device and one in the pillow 16, each of which includes a means for inflating the inflatable chamber 20. The inflation means is a valve on the underside of the flotation device. The inflatable chambers 20 in the perimeter pocket of the flotation device expand to approximately a 3-inch diameter when inflated. The coilable spring 18 is made from flexible, collapsible steel and is coated with a layer of PVC 22 to protect the coilable spring 18 from corroding and rusting due to contact with water during normal use of the flotation device. The coilable spring 18 also has memory such that will open to its uncoiled configuration when not held in the coiled configuration. The coilable spring 18 can be a single unitary element or can include sleeves 24 for joining the ends of one or more strips as shown in FIG. 3 in which the ends of the coilable spring 18 within the sleeve 24 are shown in dashed lines for clarification.

Figure 4:
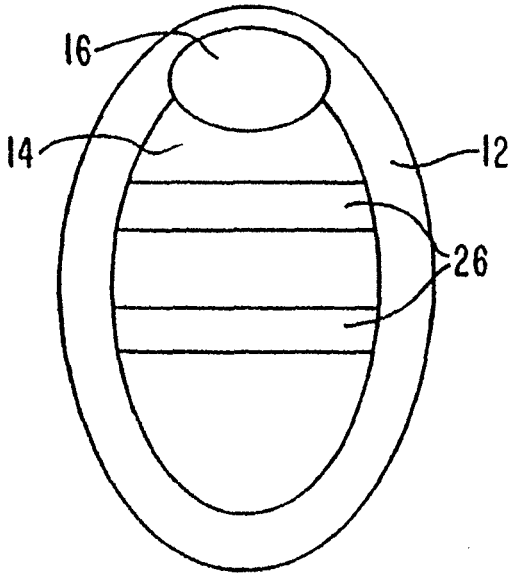
FIG. 4 is a top view of an alternate embodiment of the present invention.
Figure 5:
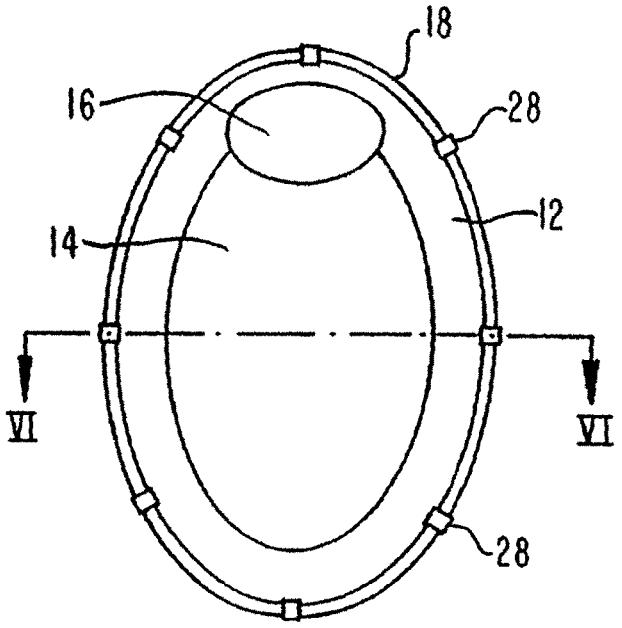
FIG. 5 is a top view of another alternate embodiment of the present invention.
Figure 6:
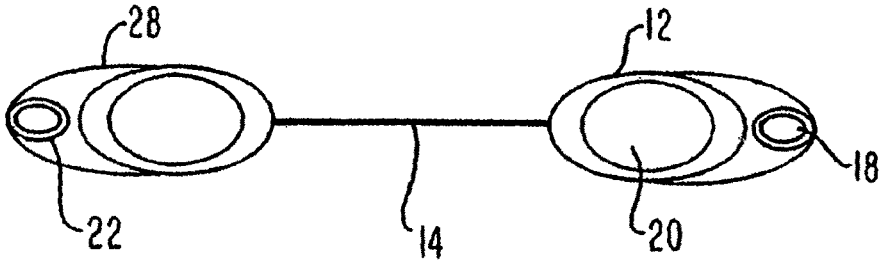
FIG. 6 is a cross section view of the alternate embodiment of the present invention across line VI-VI of FIG. 5.
Figure 7:
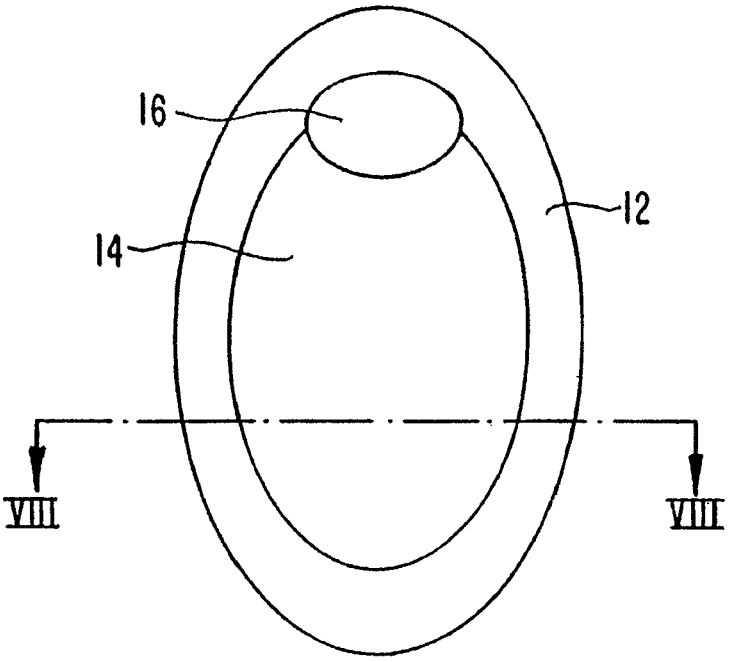
FIG. 7 is a top view of an alternative embodiment of the present invention.
Figure 8:
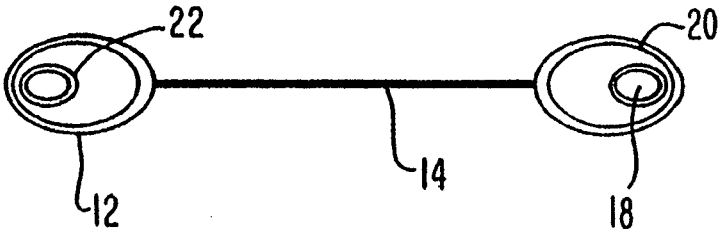
FIG. 8 is a cross sectional view of the embodiment of the present invention, taken along line VIII-VIII of FIG. 7.
Figure 9:
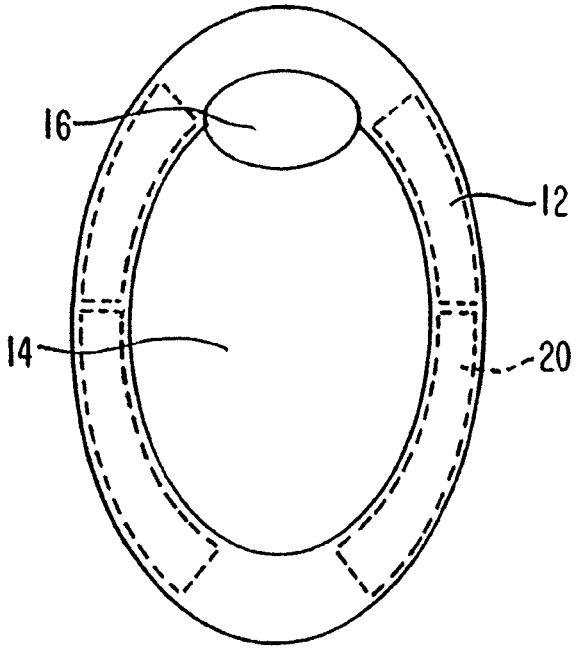
FIG. 9 is a plan view of another embodiment of the present invention.

Alternatively or in addition to the perimeter inflatable chambers, the device can include inflatable chambers 26 which cross the panel as shown in FIG. 4. FIGS. 5 and 6 show a further alternate embodiment of the present invention in which the coilable spring 18 is attached to the external perimeter of the pocket portion 12 of the flexible panel through the use of a mechanical means. In this particular embodiment, several loops 28 are used to attach the coilable spring 18 to the pocket portion 12 of the flexible panel.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A flotation apparatus, comprising:

a panel having a first end portion and a second end portion opposite the first end portion, the panel having an interior region and an outer region disposed about the interior region, the panel having a maximum length greater than a maximum width of the panel, the outer region having an inner perimeter portion, the outer region including a first inflatable chamber, the first inflatable chamber, when inflated, having a centerline that is curved;

the interior region including a liquid permeable material having an outer perimeter portion fixedly coupled to the inner perimeter portion of the outer region, the interior region including a second inflatable chamber having an end portion coupled to the outer region of the panel such that the second inflatable chamber is disposed between the first end portion of the panel and the second end portion of the panel, the second inflatable chamber, when inflated, having a centerline that is linear.

2. The flotation apparatus of claim 1, wherein the liquid permeable material is disposed (1) between the second inflatable chamber and the first end portion of the panel and (2) between the second inflatable chamber and the second end portion of the panel.

3. The flotation apparatus of claim 1, wherein the end portion of the second inflatable chamber is coupled to the outer region of the panel at a first location of the outer region of the panel, the flotation apparatus further comprising:

a third inflatable chamber having an end portion coupled to the outer region of the panel at a second location of the outer region of the panel between the first end portion of the panel and the second end portion of the panel, the second location different from the first location, the third inflatable chamber, when inflated, having a centerline that is linear.

4. The flotation apparatus of claim 1, further comprising:

a third inflatable chamber having an end portion coupled to the outer region of the panel between the first end portion of the panel and the second end portion of the panel such that the third inflatable chamber is spaced apart from the second inflatable chamber and such that a centerline of the third inflatable chamber, when inflated, is parallel to the centerline of the second inflatable chamber.

5. The flotation apparatus of claim 1, further comprising:

a third inflatable chamber having an end portion coupled to the outer region of the panel between the first end portion of the panel and the second end portion of the panel such that the liquid permeable material is disposed (1) between the second inflatable chamber and the first end portion of the panel, (2) between the second inflatable chamber and the third inflatable chamber, and (3) between the third inflatable chamber and the second end portion of the panel.

6. The flotation apparatus of claim 1, further comprising:

a coilable spring coupled substantially to an outer perimeter of the outer region of the panel, the spring being coiled while in a collapsed configuration and being uncoiled while in an expanded configuration.

7. The flotation apparatus of claim 1, wherein the outer region includes a material different from the liquid permeable material of the inner region.

8. The flotation apparatus of claim 1, wherein the liquid permeable material of the interior region is substantially planar when the first inflatable chamber is inflated and when the second inflatable chamber is inflated.

9. The flotation apparatus of claim 1, wherein the panel includes a third inflatable chamber at least partially disposed within the interior region, the third inflatable chamber is configured to support a user's head above a remaining portion of the user's body when the second inflatable chamber is inflated.

10. A flotation apparatus, comprising:

a panel having an interior region and an outer region disposed about the interior region, the interior region including a mesh material having an outer perimeter portion, the interior region having a maximum length greater than a maximum width of the interior region, the outer region including a first layer of material and a second layer of material and defining a pocket between the first layer of material and the second layer of material, an inner perimeter portion of each of the first layer of material and the second layer of material being fixedly coupled to the outer perimeter portion of the mesh material of the interior region;

a first inflatable bladder disposed within the pocket between the first layer of material and the second layer of material of the outer region of the panel;

a second inflatable bladder disposed in the interior region such that a centerline of the second inflatable bladder is disposed parallel to the maximum width of the apparatus, the mesh material of the interior region being coupled to the second inflatable bladder; and a third inflatable bladder having an end portion coupled to the outer region of the panel between a first end portion of the panel and a second end portion of the panel such that the mesh material is disposed (1) between the second inflatable bladder and the first end portion of the panel, (2) between the second inflatable bladder and the third inflatable bladder, and (3) between the third inflatable bladder and the second end portion of the panel opposite the first end portion of the panel, the flotation apparatus sized and shaped to support a weight of a user of the flotation apparatus when the flotation apparatus is disposed on water, at least one of the first inflatable bladder and the second inflatable bladder is inflated, and the user is disposed on the flotation apparatus.

11. The flotation apparatus of claim 10, wherein:

the second inflatable bladder includes an end portion coupled to the outer region of the panel at a first location of the outer region of the panel, the end portion of third inflatable bladder is coupled to the outer region of the panel at a second location of the outer region of the panel different from the first location, the third inflatable bladder, when inflated, has a centerline that is linear.

12. The flotation apparatus of claim 10, wherein the third inflatable bladder is coupled to the outer region of the panel such that the third inflatable bladder is spaced apart from the second inflatable bladder and such that a centerline of the third inflatable bladder, when inflated, is parallel to a centerline of the second inflatable bladder.

13. The flotation apparatus of claim 10, further comprising:

a spring disposed within the pocket of the outer region, the spring forming a closed loop and being moveable between a coiled configuration when the spring is collapsed and an uncoiled configuration when the spring is expanded.

14. The flotation apparatus of claim 10, wherein at least one of the first layer of material and the second layer of material is different from the mesh material.

15. The flotation apparatus of claim 10, wherein the mesh material of the interior region is substantially planar when the first inflatable bladder is inflated, when the second inflatable bladder is inflated, and when the user is not disposed on the apparatus.

16. The flotation apparatus of claim 10, further comprising:

a fourth inflatable bladder coupled to the interior region, the fourth inflatable bladder is configured to support a head of the user above a remaining portion of a body of the user when the fourth inflatable bladder is inflated.

17. A flotation apparatus, comprising:

a panel having a first end portion and a second end portion opposite the first end portion, the panel having an interior region and an outer region disposed about the interior region, the panel having a maximum length greater than a maximum width of the panel, the outer region having an inner perimeter portion, the interior region including a liquid permeable material having an outer perimeter portion fixedly coupled to the inner perimeter portion of the outer region, the interior region including a plurality of inflatable chambers, a first inflatable chamber from the plurality of inflatable chambers, when inflated, having a centerline, a second inflatable chamber from the plurality of inflatable chambers, when inflated, having a centerline that is parallel to the centerline of the first inflatable chamber;

a first inflatable bladder coupled to the outer region of the panel, the first inflatable bladder, when inflated, having a centerline that is curved; and a second inflatable bladder coupled to the panel, the second inflatable bladder configured to support a head of the user above a remaining portion of a body of the user when the second inflatable bladder is inflated.

* * * * *